US006749163B1

(12) United States Patent
Lee

(10) Patent No.: US 6,749,163 B1
(45) Date of Patent: Jun. 15, 2004

(54) WINDOW SILL EXTENSION KIT AND METHOD OF USING

(76) Inventor: David E. Lee, 31 Holden St., Attleboro, MA (US) 02703

( * ) Notice: Subject to any disclaimer, the term of this patent is extended or adjusted under 35 U.S.C. 154(b) by 0 days.

(21) Appl. No.: 10/193,847

(22) Filed: Jul. 11, 2002

(51) Int. Cl.[7] ..... A47G 29/02
(52) U.S. Cl. ..... 248/236; 248/248
(58) Field of Search ..... 248/909, 236, 248/208, 241, 247, 248, 238

(56) References Cited

U.S. PATENT DOCUMENTS

| | | | | | |
|---|---|---|---|---|---|
| 883,001 | A | * | 3/1908 | Curtis | 248/236 |
| 1,989,294 | A | * | 1/1935 | Serpico | 211/75 |
| 2,302,737 | A | * | 11/1942 | Bearden | 248/208 |
| 2,388,142 | A | * | 10/1945 | Harris | 182/61 |
| 3,354,989 | A | * | 11/1967 | Anderson | 180/69.1 |
| 3,355,133 | A | * | 11/1967 | Barcheld | 248/236 |
| 3,706,105 | A | * | 12/1972 | Nicholas et al. | 5/93.1 |
| 4,475,306 | A | * | 10/1984 | Mehrens | 47/39 |
| 4,897,958 | A | * | 2/1990 | Brydges | 47/68 |
| 5,501,040 | A | * | 3/1996 | White-Wexler et al. | 47/82 |
| 5,636,816 | A | * | 6/1997 | Burton et al. | 248/208 |
| 5,755,411 | A | * | 5/1998 | Strong et al. | 248/118 |
| 5,938,185 | A | * | 8/1999 | Kletter | 269/289 R |
| 5,967,478 | A | * | 10/1999 | Tynes | 248/241 |
| 6,022,072 | A | * | 2/2000 | Moyer | 297/182 |

FOREIGN PATENT DOCUMENTS

| | | | |
|---|---|---|---|
| GB | 1590435 | * | 6/1981 |

* cited by examiner

*Primary Examiner*—Korie Chan

(57) ABSTRACT

A new and improved window sill extension kit and method of using this kit is disclosed for use in extending the available space around the sill of a window. The window sill extension kit comprises a display deck and a support bracket. The generally rectangular display deck having a first planar area, a second planar area positioned substantially perpendicular to the first planar area and a third planar area positioned substantially perpendicular to the second planar area and positioned substantially parallel to the first planar area. The display deck configuration allows for a stable platform when the first planar area is placed in the sill and secured by a closed window. The support bracket adds additional stabilization to the display deck. The support bracket comprises an L-shaped brace, a cap attached to the top of the L-shaped brace and a base attached to the bottom of the L-shaped brace. The method of using the kit comprises the steps of opening, sliding, placing, closing, positioning, sticking, and mounting.

10 Claims, 4 Drawing Sheets

WINDOW SILL EXTENSION KIT AND METHOD OF USING

FIELD OF THE INVENTION

The present invention relates storage areas for the household, more particularly to a window sill extension kit for use in providing additional storage/display space along a window.

DESCRIPTION OF THE PRIOR ART

Often times it seems that no matter how organized a person is, there is a perpetual lack of storage spaces available within a modem household environment. Bookcases and shelves attached to walls rapidly become crowded with books, papers, toys, and other miscellaneous items. The window sill is an ideal locale for displaying plants or for even making available a perch for a pet, such as, a cat. Domestic cats typically enjoy spending large amounts of time on window sills staring at the outside world. However, many window sills tend to be relatively narrow for a cat to comfortably perch onto it. Shelves are known which can be attached by screws or the like, permanently to the interior window sill or by brackets extending outwardly beneath the window so as to be held by the closing of the window. However, these complex braces and leg support arrangements require a more or less permanent attachment of the entire shelf. Therefore, it would be desirable to have a window sill extension apparatus which does not necessarily have to be permanently mounted so that the display deck may be easily removed at the convenience of the household user.

A wide variety of window sill extension devices is currently available on the commercial market and an even larger number of these types of devices are known in the art of window sill extension devices, for example, the window perch for pet animals disclosed by Williams and Williams in U.S. Pat. No. 4,057,031; the window shelf for pets or flowers disclosed by Gordon in U.S. Pat. No. 4,869,451; the pet perch for attachment to a window sill disclosed by Elesh in U.S. Pat. No. 5,509,373; the post-n-perch disclosed by Batterton in U.S. Pat. No. 5,709,164; the combination window mounted pet/plant enclosure and carrying case in U.S. Pat. No. 5,890,455; and the window shelf disclosed by Curtin in U.S. Pat. No. D366,799.

While all of the above-described devices fulfill their respective, particular objectives and requirements, the aforementioned patents do not describe a window sill extension kit for having a support bracket comprising of an L-shaped brace, a cap attached to the top of the L-shaped brace and a base attached to the bottom of the L-shaped brace. These features that would specifically match the user's particular individual needs for making it possible to add additional support to the display deck by attaching the L-shaped brace onto the wall below the window sill and contacting the bottom of the display deck. The above-described patents make no provision for a support bracket comprising of an L-shaped brace, a cap attached to the top of the L-shaped brace and a base attached to the bottom of the L-shaped brace.

Therefore, a need exists for a new and improved window sill extension kit having a support bracket comprising of an L-shaped brace, a cap attached to the top of the L-shaped brace and a base attached to the bottom of the L-shaped brace so that additional support may be added to the display deck underneath a window. In this respect, the window sill extension kit according to the present invention substantially departs from the conventional concepts and designs of the prior art, and in doing so provides an apparatus primarily developed for the purpose of providing a stable display deck mountable within a window sill and securable by both a closed window and a support bracket which is attachable to the wall below the window.

SUMMARY OF THE INVENTION

The present device, according to the principles of the present invention, overcomes the shortcomings of the prior art by providing a new and improved window sill extension kit and method of using this kit is disclosed for use in extending the available space around the sill of a window. The window sill extension kit comprises a display deck and a support bracket. The generally rectangular display deck having a first planar area, a second planar area positioned substantially perpendicular to the first planar area and a third planar area positioned substantially perpendicular to the second planar area and positioned substantially parallel to the first planar area. The display deck configuration allows for a stable platform when the first planar area is placed in the sill and secured by a closed window. The support bracket adds additional stabilization to the display deck. The support bracket comprises an L-shaped brace, a cap attached to the top of the L-shaped brace and a base attached to the bottom of the L-shaped brace.

In view of the foregoing disadvantages inherent in the known type window sill extension kit now present in the prior art, the present invention provides an improved window sill extension kit, which will be described subsequently in great detail, is to provide a new and improved window sill extension kit which is not anticipated, rendered obvious, suggested, or even implied by the prior art, either alone or in any combination thereof.

To attain this, the present invention essentially comprises a display deck and a support bracket. The generally rectangular display deck having a first planar area, a second planar area positioned substantially perpendicular to the first planar area and a third planar area positioned substantially perpendicular to the second planar area and positioned substantially parallel to the first planar area. The display deck configuration allows for a stable platform when the first planar area is placed in the sill and secured by a closed window. The support bracket adds additional stabilization to the display deck. The support bracket comprises an L-shaped brace, a cap attached to the top of the L-shaped brace and a base attached to the bottom of the L-shaped brace.

There has thus been outlined, rather broadly, the more important features of the invention in order that the detailed description thereof that follows may be better understood, and in order that the present contribution of the art may be better appreciated.

The invention may also include an optional adhesive pad, a plurality of screws, and a drip pan. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window sill extension kit that has all the advantages of the prior art window sill extension kit and none of the disadvantages.

It is another object of the present invention to provide a new and improved window sill extension kit that may be easily and efficiently manufactured and marketed.

An even further object of the present invention is to provide a new and improved window sill extension kit that has a low cost of manufacture with regard to both materials and labor, and which accordingly is then susceptible of low prices of sale to the consuming public, thereby making such multipurpose storage unit and system economically available to the buying public.

Still another object of the present invention is to provide a new window sill extension kit that provides in the apparatuses and methods of the prior art some of the advantages thereof, while simultaneously overcoming some of the disadvantages normally associated therewith.

Even still another object of the present invention is to provide a window sill extension kit for having a support bracket comprising of an L-shaped brace, a cap attached to the top of the L-shaped brace and a base attached to the bottom of the L-shaped brace. This makes it possible to add additional support to the display deck by attaching the L-shaped brace onto the wall below the window sill and contacting the bottom of the display deck.

Lastly, it is an object of the present invention to provide a new and improved method of using the kit comprises the steps of opening, sliding, placing, closing, positioning, sticking, and mounting.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
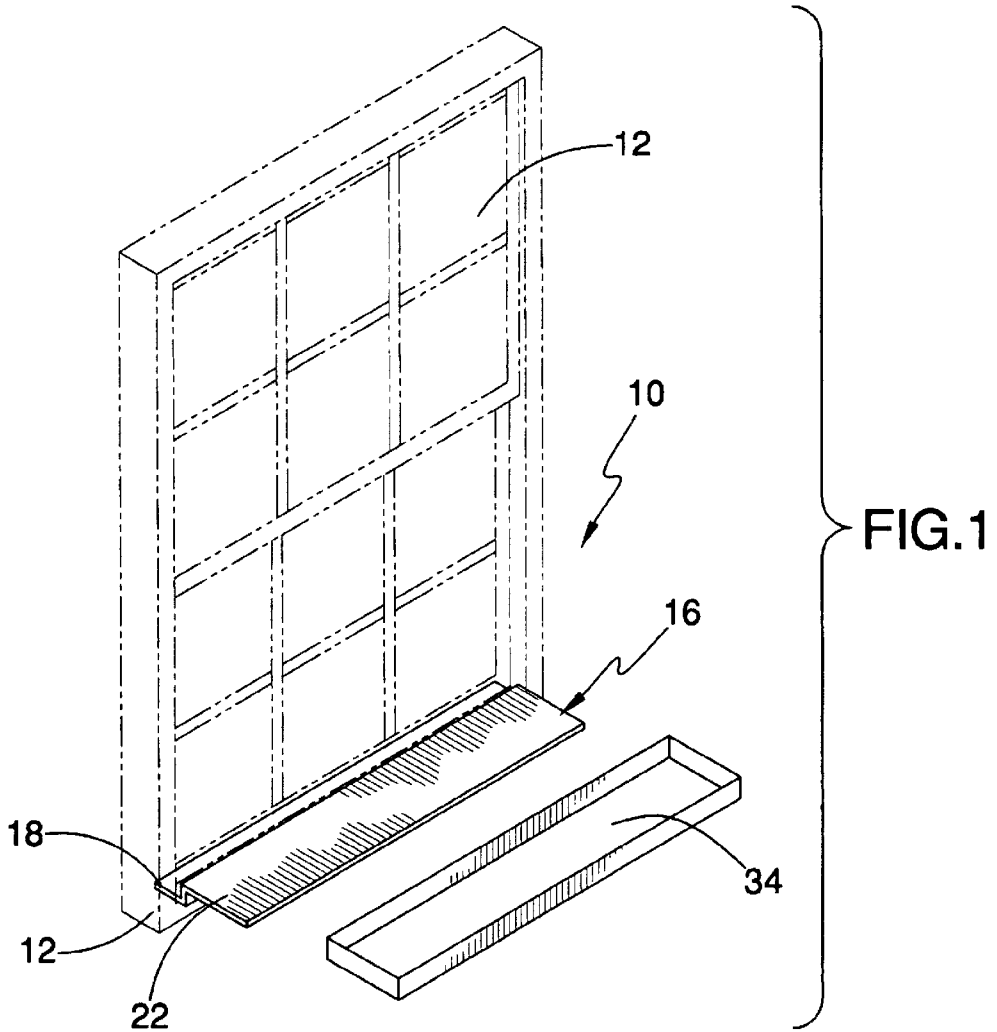
FIG. 1 is a perspective view of a preferred embodiment of the window sill extension kit constructed in accordance with the principles of the present invention.

Referring now to the drawings, and in particular FIGS. 1 to 4 thereof, one preferred embodiment of the present invention is shown and generally designated by the reference numeral 10. One preferred embodiment of the present invention of the window sill extension kit 10 for use in extending the available space around the sill 14 of a window 12, the window sill extension kit 10 comprising a display deck and a support bracket 24. The display deck 16 has a generally rectangular shape. The display deck 16 including a first planar area 18; a second planar area 20, the second planar area 20 substantially perpendicular to the first planar area 18; and a third planar area 22, the third planar area 22 substantially perpendicular to the second planar area 20 and substantially parallel to the first planar area 18. The support bracket 24 having an L-shaped brace 26; a cap 28 attached to the top of the L-shaped brace 26; and a base 30 attached to the bottom of the L-shaped brace 26.

Another preferred embodiment of the window sill extension kit 10 comprises a display deck 16, a support bracket 24 and an adhesive pad 32. The display deck 16 has a generally rectangular shape. The display deck 16 including: a first planar area 18; a second planar area 20, the second planar area 20 substantially perpendicular to the first planar; and a third planar area 22, the third planar area 22 substantially perpendicular to the second planar area 20 and substantially parallel to the first planar area 18. The display deck 16 further comprises an upper platform 38 and a lower platform 40, the lower platform 40 slidably engageable with the upper platform 38, the front end of the third planar area 22 of the upper platform 38 having an first L-shaped flap 42 extending downwardly and the back end of the first planar area 18 of the upper platform 38 having a second L-shaped flap 42 extending downwardly, wherein the first and second L-shaped flap 42s defining a sleeve for slidably engaging the lower platform 40. The support bracket 24 having an L-shaped brace 26, a cap 28 attached to the top of the L-shaped brace 26, and a base 30 attached to the bottom of the L-shaped brace 26. The adhesive pad 32 is attached to the exposed surface of the base 30 of the support bracket 24, in which the adhesive pad 32 is for attaching to the wall below the window 12.

One preferred embodiment of the method of using the window sill extension kit 10 comprises the steps of: obtaining, connecting, opening, sliding, placing, closing, positioning, sticking, and mounting. The obtaining step comprises obtaining the window sill extension kit 10 comprising: a display deck 16 having a generally rectangular shape, the display deck 16 including a first planar area 18; a second planar area 20, the second planar area 20 substantially perpendicular to the first planar; and a third planar area 22, the third planar area 22 substantially perpendicular to the second planar area 20 and substantially parallel to the first planar area 18; wherein the display deck 16 comprising an upper platform 38 and a lower platform 40, the lower platform 40 slidably engageable with the upper platform 38, the front end of the third planar area 22 of the upper platform 38 having an first L-shaped flap 42 extending downwardly and the back end of the first planar area 18 of the upper platform 38 having a second L-shaped flap 42 extending downwardly, wherein the first and second L-shaped flap 42*s* defining a sleeve for slidably engaging the lower platform 40; a support bracket 24 having an L-shaped brace 26; a cap 28 attached to the top of the L-shaped brace 26; and a base 30 attached to the bottom of the L-shaped brace 26; and an adhesive pad 32 attached to the exposed surface of the base 30 of the support bracket 24, the adhesive pad 32 for sticking to the wall below the window 12. The connecting step comprises connecting together the upper platform 38 with the lower platform 40. The opening step comprises opening the window 12. The sliding step comprises sliding the upper platform 38 and lower platform 40 together to adjust the length of the display deck 16 by match the width of the window 12. The placing step comprises placing the first planar area 18 of the display deck 16 under the window 12. The closing step comprises closing the window 12 over the first planar area 18 of the display deck 16. The positioning step comprises positioning the support bracket 24 underneath the display deck 16. The sticking step comprises sticking the adhesive pad 32 to the wall below the window 12 so that the support bracket 24 supports the display deck 16. The mounting step comprises mounting an item desired to be displayed onto the display deck 16.

The display deck 16 of the window sill extension kit 10 may be composed of a unitary structure or composed of a more complex structure. One preferred configuration of a more complex structure of the display deck 16 is that it comprises an upper platform 38 and a lower platform 40, the lower platform 40 slidably engageable with the upper platform 38. Another preferred configuration of the slidably engageable display deck 16 that it comprises an upper platform 38 and a lower platform 40, is that the front end of the third planar area 22 of the upper platform 38 has an first L-shaped flap 42 extending downwardly and the back end of the first planar area 18 of the upper platform 38 having a second L-shaped flap 42 extending downwardly, wherein the first and second L-shaped flap 42*s* defining a sleeve for slidably engaging the lower platform 40. Yet another preferred configuration of the slidably engageable display deck 16 that it comprises an upper platform 38 and a lower platform 40, is that the front end of the third planar area 22 of the lower platform 40 having an first L-shaped flap 42 extending upwardly and the back end of the first planar area 18 of the lower platform 40 having a second L-shaped flap 42 extending upwardly, wherein the first and second L-shaped flaps 42 defining a sleeve for slidably engaging the upper platform 38.

An optional adhesive pad 32 may be added to the window sill extension kit 10. The optional adhesive pad 32 may be attached to the exposed surface of the base 30 of the support bracket 24, the adhesive pad 32 for sticking to the wall below the window 12. The optional adhesive pad 32 may also be attached to the exposed surface of the cap 28 of the support bracket 24, the adhesive pad 32 for sticking to the bottom of the display deck 16.

An optional plurality of screws may be added to the window sill extension kit 10. The plurality of screws is for securing the display deck 16 onto the window 12 and for securing the support bracket 24 to the wall below the window 12.

An optional container containing an adhesive paste may be added to the window sill extension kit 10. The optional container containing an adhesive paste is for securing the support bracket 24 to the wall below the window 12.

An optional drip pan 34 may be added to the window sill extension kit 10. The optional drip pan 34 is connectable to the third planar area 22 of the display deck 16 and positionable below the third planar area 22. One preferred configuration of the optional drip pan 34 is that the display deck 16 may be made of magnetizable metal and the drip pan 34 has a magnet attached along the upper lip of the drip pan 34 so that the drip pan 34 is connectable to the third planar area 22 of the display deck 16. Another preferred configuration of the optional drip pan 34 is that the drip pan 34 is slidably connectable with the third planar area 22 of the display deck 16. Yet another preferred configuration of the slidably connectable drip pan 34 is that a pair of L-shaped flanges are attached to the two opposing sides of the third planar area 22, wherein the L-shaped flanges are positioned substantially perpendicular to the third planar area 22 and extending below the third planar area 22 so that the bottoms of the pair of L-shaped flanges point towards each other, and a drip pan 34 slidably connectable to the third planar area 22 by being engageable with the pair of L-shaped flanges. To allow over spilled plant water to be efficiently collected in the optional drip pan 34, the third planar area 22 may have a plurality of holes extending through the third planar area 22. These the holes may be elongated slits. The elongated slits may extend laterally along the width of the third planar area 22 or the elongated slits may extend horizontally along the length of the third planar area 22.

An optional line of perforations 36 may be added to the window sill extension kit 10. The optional line of perforations 36 may extend laterally along the width of the display deck 16. The perforation line is for allowing a user to adjustably shorten the length of the display deck 16 to fit within the sill 14 of the window 12 by allowing the user to break off a portion of the display deck 16 along the line of perforations 36. A plurality of lines of perforations 36 may also be added to the window sill extension kit 10, wherein all of the lines extending laterally along the width of the display deck 16 and all of the lines are substantially parallel with each other.

Referring now to FIG. 1 which depicts a perspective view of a preferred embodiment of the window sill extension kit 10 comprises a display deck and a support bracket 24. The display deck 16 has a generally rectangular shape. The display deck 16 including a first planar area 18; a second planar area 20, the second planar area 20 substantially perpendicular to the first planar area 18; and a third planar area 22, the third planar area 22 substantially perpendicular to the second planar area 20 and substantially parallel to the first planar area 18. The optional drip pan 34 is connectable to the third planar area 22 of the display deck 16 and positionable below the third planar area 22.

Figure 2:
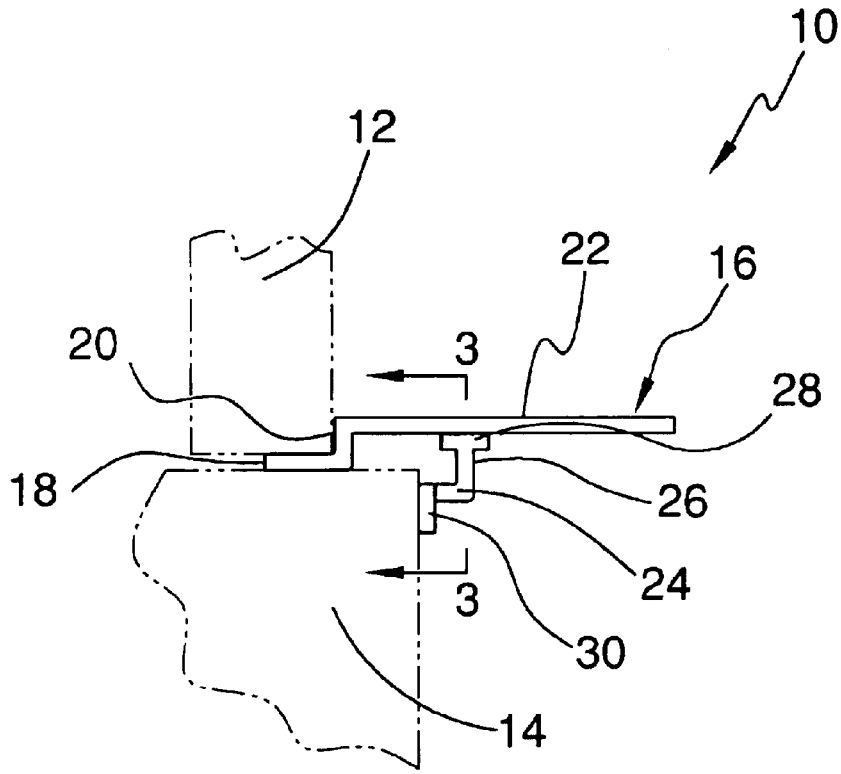
FIG. 2 is a cross sectional side view of the window sill extension kit of the present invention.

Referring now to FIG. 2, which depicts a cross sectional side view of the window sill extension kit 10 comprises a display deck and a support bracket 24. The display deck 16 includes a first planar area 18; a second planar area 20, the second planar area 20 substantially perpendicular to the first planar area 18; and a third planar area 22, the third planar area 22 substantially perpendicular to the second planar area 20 and substantially parallel to the first planar area 18. The support bracket 24 having an L-shaped brace 26; a cap 28 attached to the top of the L-shaped brace 26; and a base 30 attached to the bottom of the L-shaped brace 26.

Figure 3:
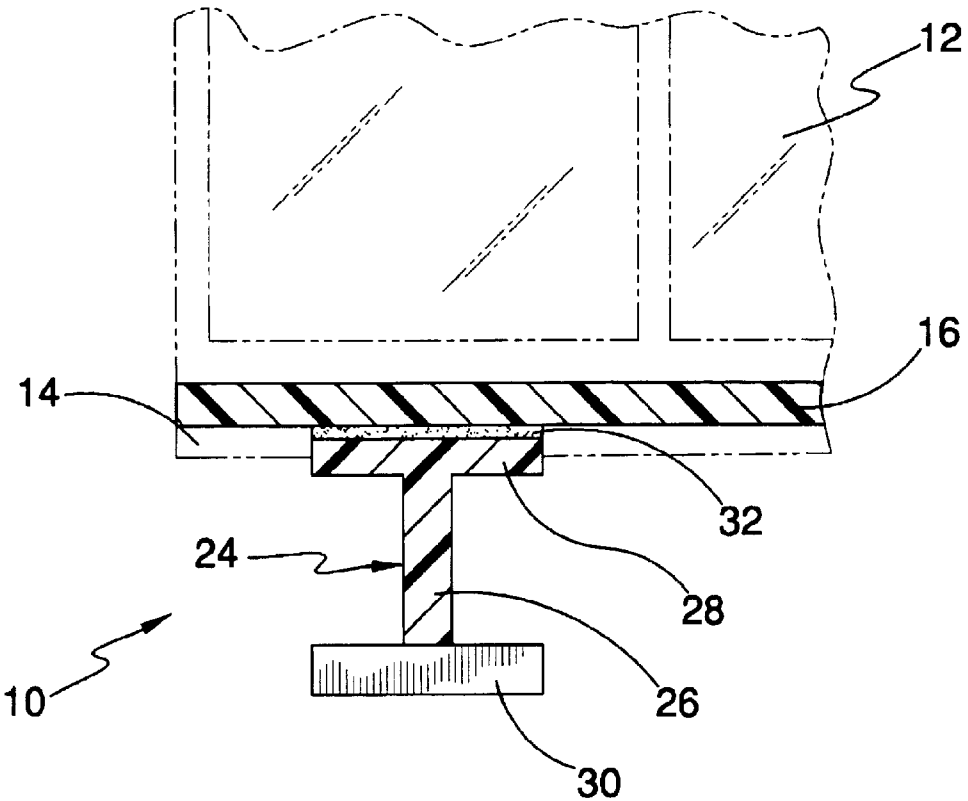
FIG. 3 is a cross sectional frontal view of the window sill extension kit of the present invention.

Referring now to FIG. 3, which depicts a cross sectional frontal view of the window sill extension kit 10 comprises a display deck, a support bracket 24 and an adhesive pad 32 The display deck 16 having a generally rectangular shape. The display deck 16 including a first planar area 18; a second planar area 20, the second planar area 20 substantially perpendicular to the first planar area 18; and a third planar area 22, the third planar area 22 substantially perpendicular to the second planar area 20 and substantially parallel to the first planar area 18. The support bracket 24 having an L-shaped brace 26; a cap 28 attached to the top of the L-shaped brace 26; and a base 30 attached to the bottom of the L-shaped brace 26. The adhesive pad 32 is attached to the exposed surface of the base 30 of the support bracket 24, in which the adhesive pad 32 is for attaching to the wall below the window 12.

Figure 4:
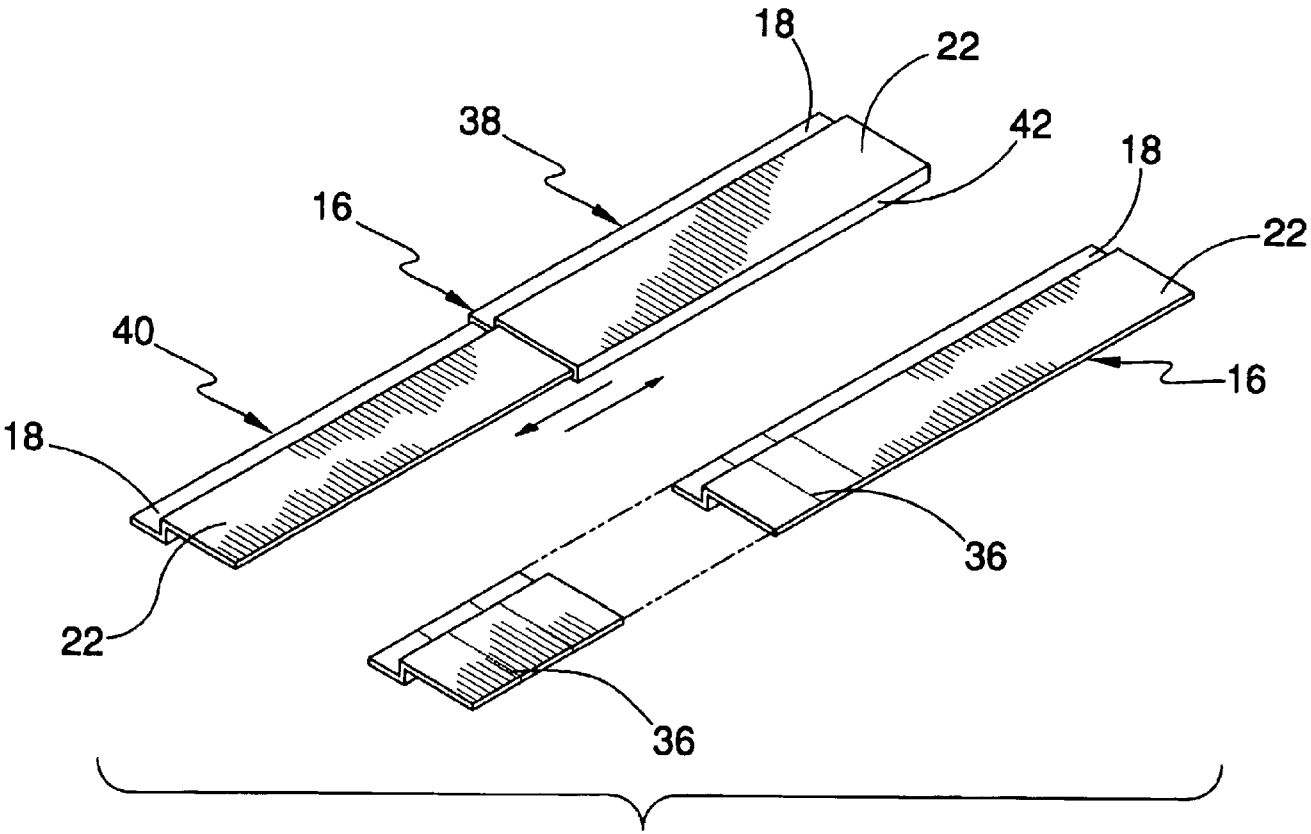
FIG. 4 is a perspective view of two configurations of the display deck of the window sill extension kit of the present invention.

Referring now to FIG. 4 which depicts a perspective view of two configurations of the display deck of the window sill extension kit 10, in which one preferred configuration of the display deck 16 is that it comprises an upper platform 38 and a lower platform 40, the lower platform 40 slidably engageable with the upper platform 38. The slidably engageable display deck 16 comprises an upper platform 38 and a lower platform 40. The front end of the third planar area 22 of the upper platform 38 has an first L-shaped flap 42 extending downwardly and the back end of the first planar area 18 of the upper platform 38 having a second L-shaped flap 42 extending downwardly, wherein the first and second L-shaped flap 42*s* defining a sleeve for slidably engaging the lower platform 40. Another preferred configuration of the display deck 16 is that it has optional line of perforations 36 extending laterally along the width of the display deck 16. The perforation line is for allowing a user to adjustably shorten the length of the display deck 16 to fit within the sill 14 of the window 12 by allowing the user to break off a portion of the display deck 16 along the line of perforations 36. A plurality of lines of perforations 36 may also be added to the window sill extension kit 10, wherein all of the lines extending laterally along the width of the display deck 16 and all of the lines are substantially parallel with each other.

As to the manner of usage and operation of the present invention, the same should be apparent from the above description. Accordingly, no further discussion relating to the manner of usage and operation will be provided.

While a preferred embodiment of the window sill extension kit has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window sill extension kit for use in extending the available space around the sill of a window, said window sill extension kit comprising:

a display deck having a generally rectangular shape, said display deck including a first planar area;

a second planar area, said second planar area substantially perpendicular to said first planar area; and a third planar area, said third planar area substantially perpendicular to said second planar area and substantially parallel to said first planar area; and a support bracket having an L-shaped brace;

a cap attached to the top of said L-shaped brace; and a base attached to the bottom of said L-shaped brace;

a container containing an adhesive paste, said adhesive paste for securing said support bracket to the wall below the window.

2. The window sill extension kit described in claim 1 wherein said display deck comprises an upper platform and a lower platform, said lower platform slidably engageable with said upper platform; wherein the front end of said third planar area of said upper platform has a first L-shaped flap extending downwardly and the back end of said first planar area of said upper platform having a second L-shaped flap extending downwardly, wherein said first and second L-shaped flaps define a sleeve for slidably engaging said lower platform.

3. The window sill extension kit described in claim 1 wherein said display deck comprises an upper platform and a lower platform, said lower platform slidably engageable with said upper platform; wherein the front end of said third planar area of said lower platform having an first L-shaped flap extending upwardly and the back end of the said first planar area of said lower platform having a second L-shaped flap extending upwardly, wherein said first and second L-shaped flaps defining a sleeve for slidably engaging said upper platform.

4. A window sill extension kit for use in extending the available space around the sill of a window, said window sill extension kit comprising:

a display deck having a generally rectangular shape, said display deck including a first planar area;

a second planar area, said second planar area substantially perpendicular to said first planar area; and a third planar area, said third planar area substantially perpendicular to said second planar area and substantially parallel to said first planar area; said third planar comprising a drip pan connectable to said third planar area of said display deck and positionable below said third planar area and a support bracket having an L-shaped brace;

a cap attached to the top of said L-shaped brace; and a base attached to the bottom of said L-shaped brace.

5. The window sill extension kit described in claim 4 wherein said display deck is made of magnetizable metal and said drip pan having a magnet attached along an upper lip of the drip pan.

6. The window sill extension kit described in claim 4 wherein said drip pan is slidably connectable with the third planar area of said display deck.

7. The window sill extension kit described in claim 6 further comprising:

a pair of L-shaped flanges attached to the two opposing sides of the third planar area, wherein the L-shaped flanges are positioned substantially perpendicular to said third planar area and extending below said third planar area so that the bottoms of said pair of L-shaped flanges point towards each other; and said drip pan slidably connectable to said third planar area by being engageable with said pair of L-shaped flanges.

8. The window sill extension kit described in claim 4 wherein said third planar area having a plurality of holes extending through said third planar area.

9. A window sill extension kit for use in extending the available space around the sill of a window, said window sill extension kit comprising:

a display deck having a generally rectangular shape, said display deck including:

a first planar area;

a second planar area, said second planar area substantially perpendicular to said first planar area; and a third planar area, said third planar area substantially perpendicular to said second planar area and substantially parallel to said first planar area;

wherein said display deck comprising an upper platform and a lower platform, said lower platform slidably engageable with said upper platform, the front end of said third planar area of said upper platform having an first L-shaped flap extending downwardly and the back end of said first planar area of said upper platform having a second L-shaped flap extending downwardly, wherein said first and second L-shaped flaps defining a sleeve for slidably engaging said lower platform;

a support bracket having:

an L-shaped brace;

a cap attached to the top of said L-shaped brace; and a base attached to the bottom of said L-shaped brace; and an adhesive pad attached to the exposed surface of said base of said support bracket, said adhesive pad for attaching to the wall below the window.

10. A method of using a window sill extension kit for use in extending the available space around the sill of a window, said method comprising the steps of:

obtaining the window sill extension kit comprising:

a display deck having a generally rectangular shape, said display deck including a first planar area;

a second planar area, said second planar area substantially perpendicular to said first planar area; and a third planar area, said third planar area substantially perpendicular to said second planar area and substantially parallel to said first planar area;

wherein said display deck comprising an upper platform and a lower platform, said lower platform slidably engageable with said upper platform, the front end of said third planar area of said upper platform having an first L-shaped flap extending downwardly and the back end of said fist planar area of said upper platform having a second L-shaped flap extending downwardly, wherein said first and second L-shaped flaps defining a sleeve for slidably engaging said lower platform;

a support bracket having:

an L-shaped brace;

a cap attached to the top of said L-shaped brace; and a base attached to the bottom of said L-shaped brace; and an adhesive pad attached to the exposed surface of said base of said support bracket, said adhesive pad for sticking to the wall below the window;

connecting together the upper platform with said lower platform; opening the window;

sliding the upper platform and lower platform together to adjust the length of the display deck by match the width of the window;

placing the first planar area of the display deck under the window;

closing the window over the first planar area of the display deck;

positioning the support bracket underneath the display deck;

sticking the adhesive pad to the wall below the window so that the support bracket supports the display deck; and mounting an item desired to be displayed onto the display deck.

* * * * *